US011252495B2

(12) United States Patent
Clark et al.

(10) Patent No.: US 11,252,495 B2
(45) Date of Patent: Feb. 15, 2022

(54) HEADPHONE PAD MOUNTING SYSTEM

(71) Applicant: MrSpeakers, LLC, San Diego, CA (US)

(72) Inventors: Daniel William Clark, San Diego, CA (US); Robert Jason Egger, San Diego, CA (US)

(73) Assignee: Dan Clark Audio, Inc., San Diego, CA (US)

( * ) Notice: Subject to any disclaimer, the term of this patent is extended or adjusted under 35 U.S.C. 154(b) by 0 days.

(21) Appl. No.: 16/781,694

(22) Filed: Feb. 4, 2020

(65) Prior Publication Data

US 2020/0252709 A1 Aug. 6, 2020

Related U.S. Application Data

(60) Provisional application No. 62/800,844, filed on Feb. 4, 2019.

(51) Int. Cl.
*H04R 1/10* (2006.01)

(52) U.S. Cl.
CPC ..... *H04R 1/105* (2013.01); *H04R 1/1075* (2013.01); *H04R 1/1066* (2013.01)

(58) Field of Classification Search
CPC ..... H04R 1/105; H04R 1/1075; H04R 1/1066
See application file for complete search history.

(56) References Cited

U.S. PATENT DOCUMENTS

| | | | | |
|---|---|---|---|---|
| 5,761,314 | A | 6/1998 | Inanaga et al. | |
| 6,980,666 | B1 | 12/2005 | Owen | |
| 8,090,134 | B2 | 1/2012 | Takigawa et al. | |
| 8,363,876 | B2 | 1/2013 | Miskiel et al. | |
| 9,113,253 | B2 | 8/2015 | Yoshida | |
| 9,185,483 | B2 | 11/2015 | Solomon et al. | |
| 9,319,770 | B2 | 4/2016 | Oishi | |
| 10,398,188 | B2 | 9/2019 | Mansilla et al. | |
| 2013/0177165 | A1* | 7/2013 | Oishi | H04R 3/04 381/74 |
| 2016/0302000 | A1* | 10/2016 | Shin | H04R 1/1016 |
| 2018/0041827 | A1 | 2/2018 | Abdelmalek | |
| 2018/0316999 | A1 | 11/2018 | Bellas et al. | |
| 2019/0069065 | A1* | 2/2019 | Brace | H04R 1/1058 |
| 2019/0394555 | A1 | 12/2019 | Ito et al. | |

FOREIGN PATENT DOCUMENTS

| | | | |
|---|---|---|---|
| CN | 104519440 | * | 4/2015 |
| JP | 6274654 B2 | * | 2/2018 |

* cited by examiner

*Primary Examiner* — Regina N Holder
(74) *Attorney, Agent, or Firm* — Hall Estill Law Firm

(57) ABSTRACT

A headphone may employ an ear pad mounted to a housing. Affixing a soft sticky or tacky non-adhesive polymer base to the underside of a headphone ear pad allows easy attachment of ear pads to a headphone with the ability to frequently and non-destructively swap pads, without the weight, bulk and fragility of other pad attachment mechanisms.

15 Claims, 2 Drawing Sheets

HEADPHONE PAD MOUNTING SYSTEM

RELATED APPLICATION

The present application makes a claim of domestic priority to U.S. Provisional Patent Application No. 62/800,844 filed Feb. 4, 2019, the contents of which are hereby incorporated by reference.

SUMMARY

In accordance with some embodiments, Affixing a soft sticky or tacky non-adhesive polymer base to the underside of a headphone ear pad in lieu of one of the aforementioned mounting methods allows easy attachment of ear pads to a headphone with the ability to frequently and non-destructively swap pads, without the weight, bulk and fragility of other pad attachment methods.

DETAILED DESCRIPTION

Figure 1:
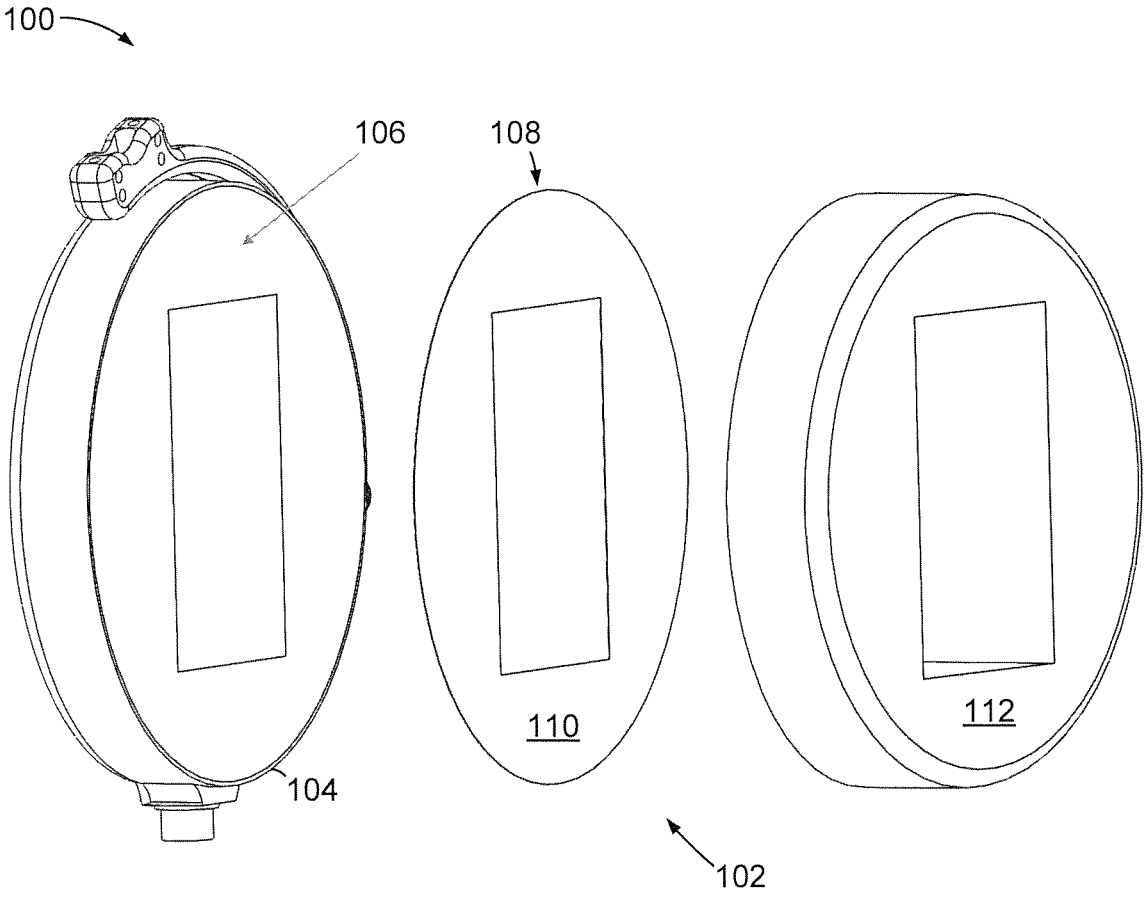
FIG. 1 conveys a line representation of portions of an example headphone in which various embodiments may be practiced.

Various embodiments are generally directed to structure and methods of mounting a pad of a headphone.

Owners of headphones have the ability to replace ear pads for various reasons, such as the ear pads have worn out, different comfort, or to modify the sound of a headphone. Conventional replaceable ear pads mount to the headphone using a relatively complex fastener, such as a bayonet-coupler, magnets, stretching-to-fit, or adhesives.

While the various existing ear pad fasteners allow for the replacement of ear pads, each fastener has its own unique set of compromises that limit the utility of each approach. For instance, bayonet-style couplers increase the size of a headphone assembly, adding weight, and are often fragile and easily broken, which makes them impractical for frequent exchange of ear pads. Thus, bayonet-style ear pad fasteners are either heavy or fragile, while being prone to breaking the bayonets and requiring replacement mounting plates.

Magnetic couplers can be more effective than bayonet-style ear pad fasteners by being more durable and reliable for frequent pad changes. However, magnetic couplers add weight and bulk to a headphone, which reduce comfort and, in worst-case scenarios, interact with the magnetic field for the headphone audio transducer to degrade sound quality. As such, magnetic ear pad fasteners can be bulky and heavy, and adhesives or stretching are typically only useful for one or two pad changes.

The use of adhesives as fasteners can provide a very reliable and lightweight fastener, but a strong adhesive material can destroy an ear pad upon removal from a headphone. Such adhesives can furthermore degrade over time and through use, which can destroy the practicality, comfort, and enjoyment of a headphone.

Stretch-mounting ear pad fasteners typically allow for pad exchange, but over time can experience degraded performance as the stretch material changes, which causes a loose fit. Additionally, stretch-mounting ear pad fasteners typically add bulk and weight to the headphone ear-cup assembly to the detriment of comfort and practicality of the headphone. Hence, current headphone ear pad fastening systems add weight and bulk, and in most cases do not support frequent exchange of ear pads. Meanwhile, the systems that do allow frequent ear pad changes typically materially increase the size and weight of a headphone, which serves as an inconvenience to users.

Accordingly, various embodiments are directed at headphone structure that allows the cyclic attachment ear pads to a headphone using a non-adhesive tacky or sticky polymer, such as, but not limited to, polyurethane gel elastomer, which provides headphone owners a lightweight, convenient and durable way to easily exchange ear pads as frequently as desired to maintain a headphone or to change pads to reversibly alter the headphone sound. The sticky polymer, in various embodiments, can be permanently attached to the headphone using an adhesive transfer tape leaving the sticky, or tacky, side to secure the ear pad, or vice versa.

By eliminating the weight and bulk or fragility of other headphone ear pad mounting mechanisms, whilst maintaining the ability to frequently exchange ear pads without damaging them, embodiments of the ear pad mounting system described in this disclosure allows for lighter, more compact headphones that offers users the ability to easily exchange their ear pads.

FIG. 1 conveys an exploded line representation of portions of an example headphone 100 that can employ an ear pad mounting system 102 in accordance with assorted embodiments. As shown, an ear cup 104 of the headphone 100 has a baffle 106 that is acoustically coupled to one or more audio transducers positioned within the ear cup. It is noted that while a single headphone ear cup 104 is illustrated in FIG. 1, it is contemplated that the headphone 100 comprises a pair of matching, but oppositely oriented, ear cups 104 each configured to surround the respective ears of a user.

A soft sticky, or tacky, non-adhesive polymer base 108, such as an elastomer gel, can provide a substrate for one or more adhesives 110 that allow the base 108 to be attached to the underside of a headphone ear pad 112. The use of the polymer base 108 and adhesive 110 in lieu of one of the aforementioned ear pad fasteners allows for easy ear pad 112 attachment to headphone ear cup 104 with the ability to frequently and non-destructively swap pads, without the weight, bulk and fragility of other ear pad attachment methods.

In some embodiments, the ear pad 112 is constructed of a single material, such as foam, silicone, rubber, or plastic, while other embodiments utilize more than one material to form the ear pad 112 to provide user comfort and optimal acoustic quality when contacting the ear of a user. The use of different kinds of silicone is contemplated, such as bio-safe molded silicone.

The polymer base 108 is shown to have a matching shape to the headphone baffle 106, but such configuration is not required. The base 108 may be one or more layers of similar, or dissimilar, materials that allow for secure ear pad mounting to the ear cup 104 without the use of adhesives, magnets, or complex fasteners. That is, the use of the polymer base 108 to physically attach to the ear cup 104, instead of adhesive or magnets, allows for lightweight, efficient ear pad 112 attachment. Accordingly, it is contemplated that the ear cup baffle 106 is constructed of a material that can securely, while cyclically secure the ear pad 112.

Figure 2:
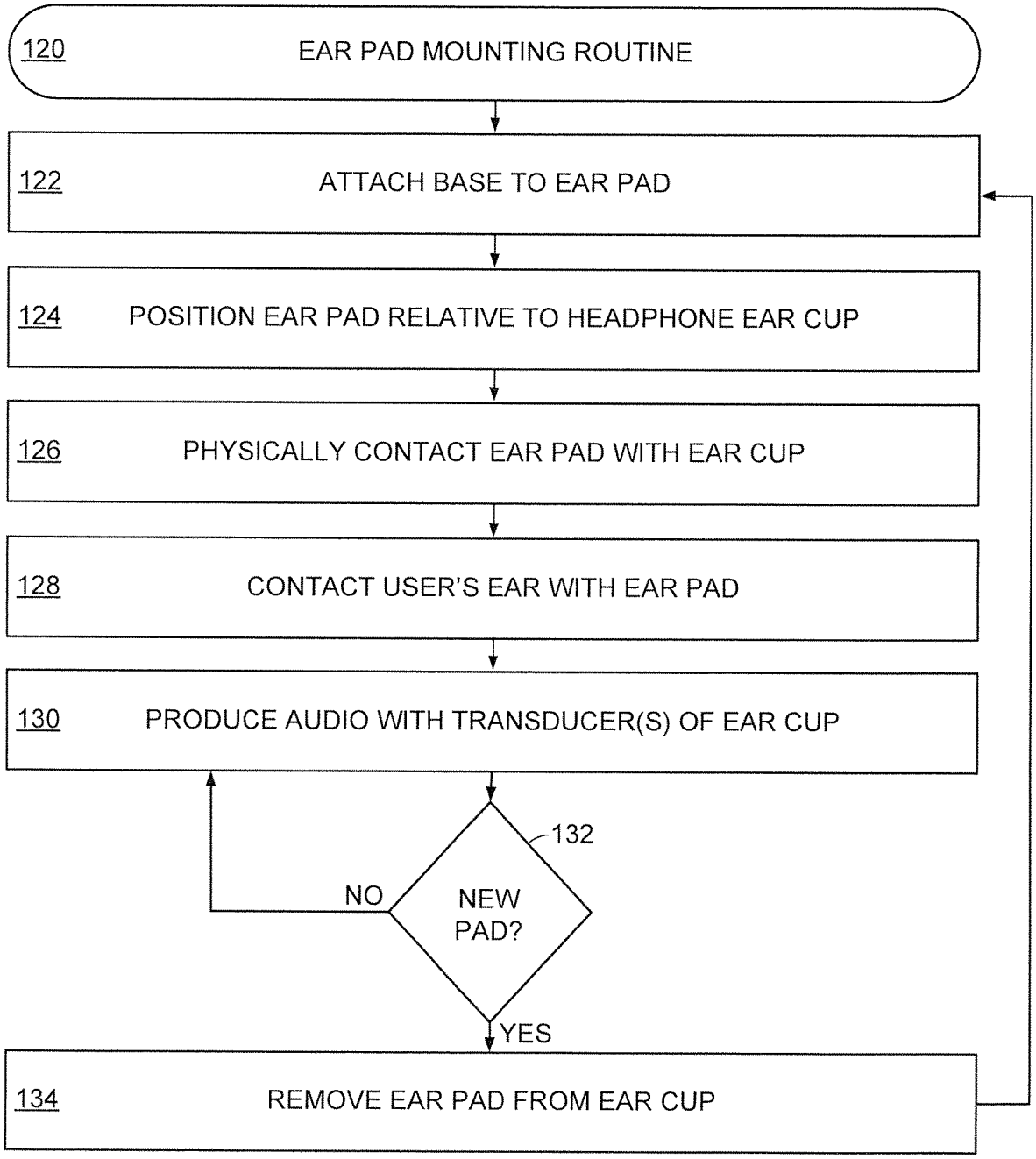
FIG. 2 depicts an example pad mounting routine that can be carried out with the assorted aspects of the headphone of FIG. 1.

FIG. 2 depicts an example ear pad mounting routine 120 that can be executed with a headphone employing at least one ear pad mounting system 102. The routine 120 initially attaches a polymer base to an ear cup with one or more adhesives in step 122. The ability to position the base on any ear cup allows a user to customize the position of the ear pad relative to an ear cup, which can optimize comfort and audio quality. It is contemplated, but not required, that the polymer base is permanently attached to the ear pad via the adhesive (s).

With the ear pad connected to the polymer base, step 124 positions the ear pad proximal to an ear cup of a headphone. The positioning of step 124 can further allow a user to customize the orientation of the ear cup to provide optimized, personal comfort and audio quality. For instance, the ear pad may be positioned proximal to, and subsequently attached in step 126 to, the ear cup so that the ear cup extends outside the areal extent of the ear cup, which can cater the fit of the ear pad to the head/ear of the user.

Regardless of the position of the ear pad relative to the ear cup, the headphone is then worn by the user, as defined by the ear pad contacting the ear of the user in step 128. Next, audio signals are reproduced by one or more transducers of the ear cup into audible sound in step 130 that travels through the base and ear pad to the ear canal of the user.

The continuous, or sporadic, reproducing of sound in step 130 can be conducted for any amount of time. However, the user may desire to change the ear pad, as evaluated in decision 132. If such desire exists, step 134 is triggered to remove the headphone from the head of the user and the ear pad from the ear cup. It is noted that the use of the polymer base allows the ear pad to be securely connected to another ear cup without any medication to the ear pad or base.

What is claimed is:

1. A method comprising:

affixing a non-adhesive polymer base to an underside of an ear pad, the non-adhesive polymer base comprising a gel elastomer;

attaching the ear pad to a headphone housing; and playing sound via an acoustic driver positioned within the headphone housing.

2. The method of claim 1, wherein the non-adhesive polymer base is affixed to the ear pad via at least one adhesive.

3. The method of claim 1, wherein the ear pad is attached to an ear cup of the headphone housing.

4. The method of claim 1, wherein the ear pad contacts a baffle of the headphone housing.

5. The method of claim 1, wherein the ear pad comprises a single material.

6. The method of claim 1, wherein the ear pad comprises a multiple different materials.

7. A method comprising:

affixing a non-adhesive polymer base to an underside of an ear pad, the non-adhesive polymer base comprising only a gel elastomer;

attaching the first ear pad to a headphone housing;

playing sound via an acoustic driver positioned within the headphone housing;

removing the first ear pad from the headphone housing; and attaching a second ear pad to the headphone housing.

8. The method of claim 7, wherein the headphone housing is unaltered between removal of the first ear pad and attachment of the second ear pad.

9. The method of claim 7, wherein the first ear pad and second ear pad each have separate non-adhesive polymer bases.

10. The method of claim 7, wherein the first ear pad is positioned in alignment with the headphone housing and the second ear pad overlaps an edge of the headphone housing.

11. The method of claim 7, wherein a user customizes the position of the non-adhesive polymer base relative to the underside of the ear pad.

12. A method comprising:

affixing a non-adhesive polymer base to an underside of an ear pad the non-adhesive polymer base comprising a gel elastomer;

attaching the ear pad to a headphone housing in a first position;

playing sound via an acoustic driver positioned within the headphone housing;

removing the ear pad from the headphone housing; and re-attaching the ear pad to the headphone housing in a second position.

13. The method of claim 12, wherein the first position and the second position are different relative to an ear cup of the headphone housing.

14. The method of claim 12, wherein the ear pad is re-attached to the headphone housing without altering the headphone housing or non-adhesive polymer base.

15. The method of claim 12, wherein the ear pad is re-attached to the headphone housing cyclically over time without altering the headphone housing or non-adhesive polymer base.

* * * * *